US011274421B2

(12) United States Patent
Sharma et al.

(10) Patent No.: US 11,274,421 B2
(45) Date of Patent: Mar. 15, 2022

(54) EFFICIENT SECONDARY CONTROL DEVICE FOR A WORK MACHINE

(71) Applicant: Caterpillar Inc., Deerfield, IL (US)

(72) Inventors: Amit Sharma, Dunlap, IL (US); Steven Budde, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 264 days.

(21) Appl. No.: 16/521,194

(22) Filed: Jul. 24, 2019

(65) Prior Publication Data

US 2021/0025145 A1 Jan. 28, 2021

(51) Int. Cl.

| | |
|---|---|
| ***E02F 9/26*** | (2006.01) |
| ***E02F 3/76*** | (2006.01) |
| ***E02F 3/84*** | (2006.01) |
| ***E02F 9/20*** | (2006.01) |

(52) U.S. Cl.

CPC ..... *E02F 9/265* (2013.01); *E02F 3/7636* (2013.01); *E02F 3/844* (2013.01); *E02F 9/2033* (2013.01)

(58) Field of Classification Search

CPC ..... E02F 9/265; E02F 9/2033; E02F 3/7636; E02F 3/844

See application file for complete search history.

(56) References Cited

U.S. PATENT DOCUMENTS

| | | | | |
|---|---|---|---|---|
| 7,612,464 | B2 | 11/2009 | Yano | |
| 7,882,394 | B2 | 2/2011 | Hosek et al. | |
| 9,206,026 | B2 | 12/2015 | Aulton et al. | |
| 10,017,912 | B2 * | 7/2018 | Singh | E02F 3/432 |
| 2006/0293831 | A1 * | 12/2006 | Yano | F02D 41/221 701/114 |
| 2011/0264337 | A1 * | 10/2011 | Takanashi | F02D 29/04 701/50 |
| 2016/0208832 | A1 * | 7/2016 | Du | E02F 9/2292 |
| 2017/0300040 | A1 * | 10/2017 | Butler | E02F 9/265 |
| 2018/0127951 | A1 * | 5/2018 | Taylor | E02F 9/268 |
| 2020/0063640 | A1 * | 2/2020 | Lee | F01P 7/165 |

FOREIGN PATENT DOCUMENTS

| | | | |
|---|---|---|---|
| EP | 1405769 | A1 | 4/2004 |
| WO | 2017190819 | A1 | 11/2017 |

* cited by examiner

*Primary Examiner* — Tyler J Lee
*Assistant Examiner* — Yufeng Zhang
(74) *Attorney, Agent, or Firm* — Harrity & Harrity LLP

(57) ABSTRACT

A secondary control device may obtain main control information regarding an implement. The secondary control device may obtain monitoring information regarding the implement. The secondary control device may determine, using a first reduced functionality processing technique, secondary control information regarding the implement based on the monitoring information. The secondary control device may determine, using a second functionality processing technique, based on the main control information, the monitoring information, or the secondary control information, that a critical error associated with the implement has occurred. The secondary control device may determine a circumstance associated with the critical error. The secondary control device may select, based on determining the circumstance, a control technique and may control the implement using the control technique.

20 Claims, 6 Drawing Sheets

100

300

EFFICIENT SECONDARY CONTROL DEVICE FOR A WORK MACHINE

TECHNICAL FIELD

The present disclosure relates generally to a control device and, more particularly, to a secondary control device for a work machine, such as a motor grader machine.

BACKGROUND

A work machine, such as a motor grader, a backhoe loader, an agricultural tractor, a wheel loader, a skid-steer loader, and/or other heavy equipment, is used for a variety of tasks requiring control of the work machine and various work implements associated with the work machine. In some cases, the work machine may utilize a main control device to generate control information to control the work machine or an implement of the work machine. However, the main control device may malfunction or generate erroneous control information. This may cause the work machine or the implement to move or act in an undesired manner, which may damage the work machine or the implement, may damage other physical property, and/or the like.

One attempt to monitor an electronic control system is disclosed in U.S. Pat. No. 7,612,464 that issued to Yano on Nov. 3, 2009 ("the '464 patent"). In particular, the '464 patent discloses a self-monitor that works to monitor the validity of an instruction operation of a controller which produces a command (i.e., a drive command) to be outputted to a driver circuit. Per the '464 patent, the controller works to compute a target position of a throttle valve based on a signal (e.g., a stroke of an accelerator pedal of a vehicle) inputted through an input circuit and works to sample a simulation parameter (i.e., a dummy of the input signal), to perform a given operation (i.e., an algorithm used to compute the target position of the throttle valve) on the simulation parameter. As disclosed in the '464 patent, the self-monitor determines that a result of the operation on the simulation parameter is coincident with an expected value A or not to analyze the correctness or validity of the instruction operation of the controller. If not, per the '464 patent, the self-monitor determines that the controller is failing to produce the drive command to be outputted to the driver circuit.

While the '464 patent discloses a self-monitor to monitor the validity of an instruction operation of a controller, the self-monitor relies on the controller to process a simulation parameter in order to do so. This requires the controller to perform extra processing to facilitate monitoring of the controller by the self-monitor. Moreover, processing the simulation parameter may interfere with the controller processing a signal to compute a target position of the throttle, which may affect an acceleration performance of the vehicle.

The secondary control device of the present disclosure solves one or more of the problems set forth above and/or other problems in the art.

SUMMARY

According to some implementations, a method may include obtaining, by a device, main control information regarding an implement; obtaining, by the device, monitoring information regarding the implement; determining, by the device and using a first reduced functionality processing technique, secondary control information regarding the implement based on the monitoring information; determining, by the device and using a second functionality processing technique, based on the main control information, the monitoring information, or the secondary control information, that a critical error associated with the implement has occurred; determining, by the device, a circumstance associated with the critical error; selecting, by the device and based on determining the circumstance, a control technique; and controlling, by the device, the implement using the control technique.

According to some implementations, a device may include one or more memories, and one or more processors communicatively coupled to the one or more memories, to: obtain main control information regarding an implement from a different device; obtain monitoring information regarding the implement; determine, using a first reduced functionality processing technique, secondary control information regarding the implement based on the monitoring information; determine, using a second functionality processing technique, based on the main control information, the monitoring information, or the secondary control information, that a critical error associated with the implement has occurred; determine a circumstance associated with the critical error; select, based on determining the circumstance, a reduced functionality control technique or an increased functionality control technique; and control the implement based on the selection.

According to some implementations, a work machine may comprise: an implement; a main control device capable of generating main control information to control the implement based on main monitoring information regarding the implement; and a secondary control device to: obtain the main control information and the main monitoring information from the main control device; obtain secondary monitoring information regarding the implement; determine, using a first reduced functionality processing technique, secondary control information regarding the implement based on the secondary monitoring information; select a second functionality processing technique based on the main control information, the main monitoring information, the secondary monitoring information, or the secondary control information; determine, using the second functionality processing technique, based on the main control information, the main monitoring information, the secondary monitoring information, or the secondary control information, that a critical error associated with the implement has occurred; determine a circumstance associated with the critical error; select, based on determining the circumstance, a control technique; and control the implement using the control technique.

DETAILED DESCRIPTION

This disclosure relates to a secondary control device. The secondary control device has universal applicability to any machine, such as a work machine. The term "work machine" may refer to any machine that performs an operation associated with an industry such as, for example, mining, construction, farming, transportation, or any other industry. Although some implementations described herein relate to a motor grader, the implementations also apply to other types of work machines, such as a vehicle, a tractor, a dozer, or other above ground equipment, underground equipment, or marine equipment. Moreover, one or more implements may be connected to a work machine and driven from the secondary control device.

Figure 1:
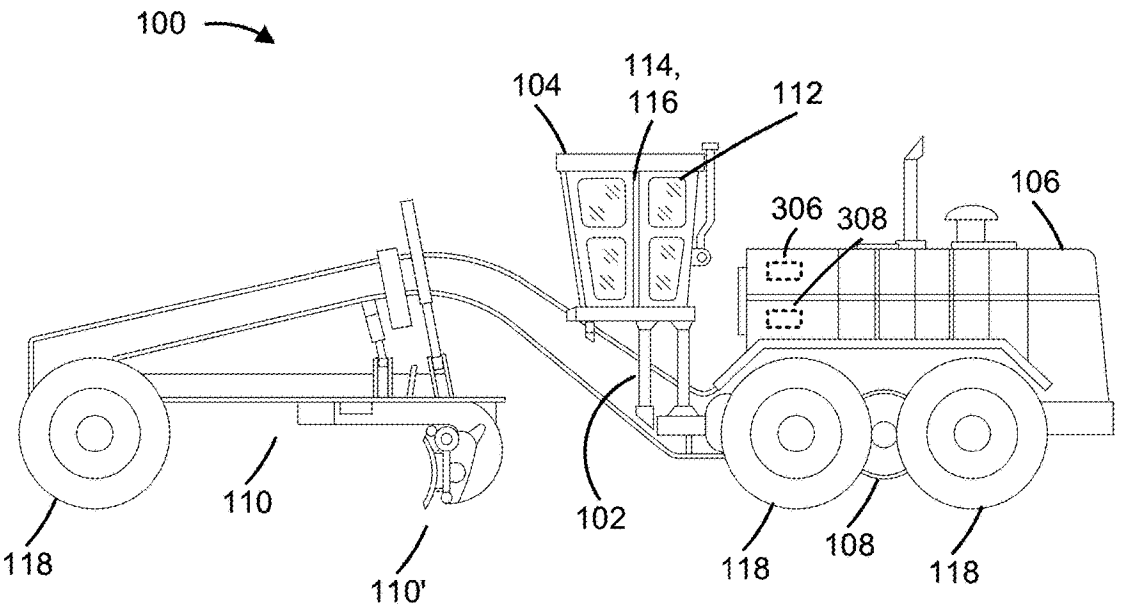
FIGS. 1-2 are diagrams of an example work machine that includes a secondary control device described herein.

FIG. 1 is a diagram of an example work machine 100 that includes a main control device 306 and a secondary control device 308. The work machine 100 is shown as a motor grader but may include any suitable type of work machine.

As shown in FIG. 1, work machine 100 may have a frame 102 that supports an operator station 104, a power system 106, a drive system 108, and an implement 110. The operator station 104 may include operator controls 112 for operating the work machine 100 via the power system 106. The illustrated operator station 104 is configured to define an interior cabin 114 within which the operator controls 112 are housed and which is accessible via a door 116. The operator controls 112 may interact with the main control device 306 and the secondary control device 308 to control power system 106, drive system 108, and/or implement 110.

The power system 106 is configured to supply power to the work machine 100. The power system 106 may be operably arranged with the operator station 104 to receive control signals from the operator controls 112 in the operator station 104, the main control device 306, and the secondary control device 308. Additionally, or alternatively, the power system 106 may be operably arranged with the drive system 108 and/or the implement 110 to selectively operate the drive system 108 and/or the implement 110 according to control signals received from the operator controls 112, the main control device 306, and the secondary control device 308.

The power system 106 may provide operating power for the propulsion of the drive system 108 and/or the operation of the implement 110. The power system 106 may include an engine and a transmission. The engine may be any type of engine suitable for performing work using the work machine 100, such as an internal combustion engine, a diesel engine, a gasoline engine, a gaseous fuel-powered engine, an electric motor, and/or the like. The transmission may transfer power from the engine to the drive system 108 and/or the implement 110. The transmission may provide a number of gear ratios that enable the work machine 100 to travel at a relatively wide range of speeds and/or conditions via the drive system 108, and/or that enable the use of the implement 110 to perform work.

The drive system 108 may be operably arranged with the power system 106 to selectively propel the work machine 100 in accordance with control signals from the operator controls 112, the main control device 306, and the secondary control device 308. The drive system 108 can include a plurality of ground-engaging members, such as wheels 118, as shown, which can be movably connected to the frame 102 through axles, drive shafts, and/or other components. The drive system 108 may be provided in the form of a track-drive system, a wheel-drive system, or any other type of drive system configured to propel the work machine 100.

The implement 110 may be operably arranged with the power system 106 such that the implement 110 is movable through control signals transmitted from the operator controls 112, the main control device 306, and the secondary control device 308 to the power system 106. The illustrated implement 110 is a drawbar-circle-moldboard assembly (DCM) with a blade 110'. In other words, implement 110 may be a DCM onto which is mounted blade 110' and which articulates with respect to the work machine 100. Other embodiments can include any other suitable implement for performing a variety of tasks, including, for example, ripping, dozing, brushing, compacting, grading, lifting, loading, plowing, and/or the like. Example implements include rippers, dozers, augers, buckets, breakers/hammers, brushes, compactors, cutters, forked lifting devices, grader bits and end bits, grapples, and/or the like. Although some implementations are described herein in terms of an articulated implement, other implements with a property (e.g., a position, orientation, engagement, and/or the like) that can be controlled by the operator controls 112, the main control device 306, and/or the secondary control device 308 are contemplated as well.

As indicated above, FIG. 1 is provided as an example. Other examples may differ from what is described in connection with FIG. 1.

Figure 2:
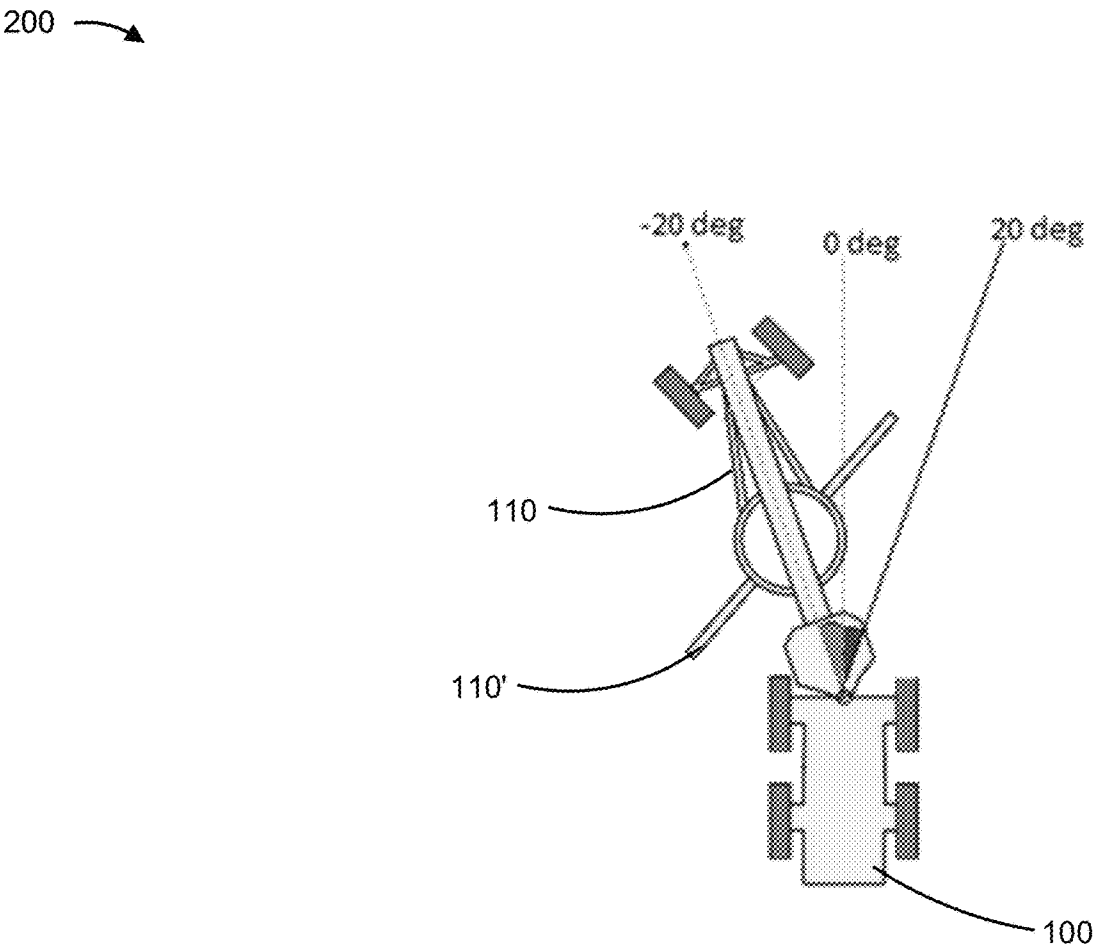

As shown in FIG. 2, and by reference number 200, in an example implementation when work machine 100 is a motor grader, the implement 110 (and the blade 110' of the implement 110) may be articulated (e.g., around an articulation joint of the implement 110) in a particular direction (e.g., shown in FIG. 2 as −20 degrees or 20 degrees from a 0 degree position of the work machine 100). The main control device 306 and/or the secondary control device 308 may control the implement 110 and/or the blade 110' to move the implement 110 and/or the blade 110' to a particular position, such as a neutral position (e.g., shown in FIG. 2 as 0 degrees).

As indicated above, FIG. 2 is provided as an example. Other examples may differ from what is described in connection with FIG. 2.

Figure 3:
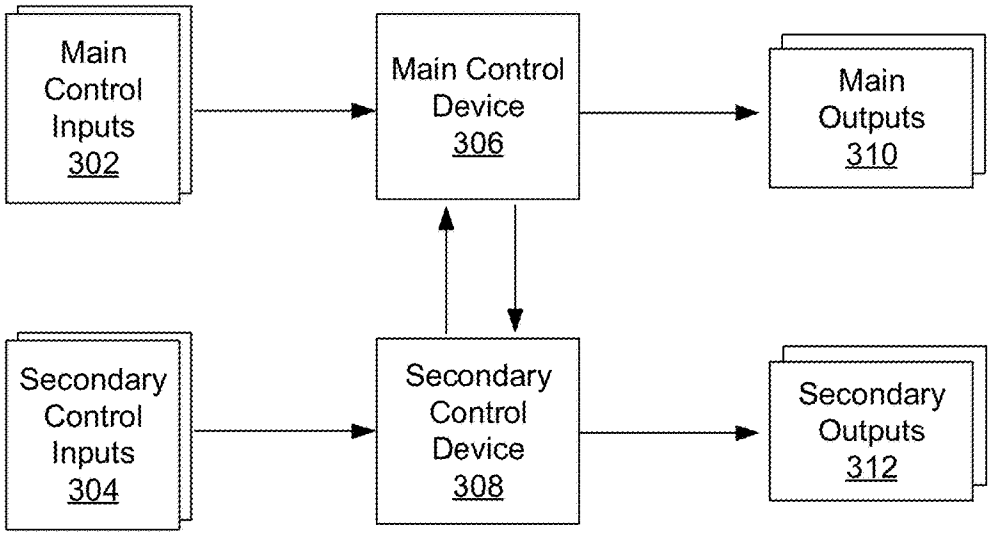
FIG. 3 is a diagram of an example environment in which systems and/or methods described herein may be implemented.

FIG. 3 is a diagram of an example environment 300 in which systems and/or methods described herein may be implemented. As shown in FIG. 3, environment 300 may include one or more main control inputs 302, one or more secondary control inputs 304, the main control device 306, the secondary control device 308, one or more main outputs 310, one or more secondary outputs 312, and/or the like. Devices of environment 300 may interconnect via wired connections, wireless connections, or a combination of wired and wireless connections.

The main control inputs 302 may include a set of sensor devices that send main monitoring information, such as information (e.g., status information) regarding work machine 100, implement 110, and/or the like, to the main control device 306. For example, main control inputs 302 may include a steering angle sensor, a steering lever sensor, a work machine speed sensor, an articulation angle sensor, an articulation lever sensor, a hydraulic oil temperature sensor, an implement position and/or orientation sensor, a timer, and/or the like. For example, a steering angle sensor may provide information indicating an actual steering angle for the work machine 100 (e.g., a command being provided to the main control device 306) and the steering lever sensor may provide information indicating an intended steering angle of the machine 100. Similarly, an articulation angle sensor may provide information indicating an actual articulation angle of the implement 110 and the articulation lever sensor may provide information indicating an intended articulation angle (e.g., a command being provided to the main control device 306) of the implement 110.

The secondary control inputs 304 may include a set of sensor devices that send secondary monitoring information, such as information (e.g., status information) regarding work machine 100, implement 110, and/or the like to the secondary control device 308. For example, secondary control inputs 304 may include a steering angle sensor, a steering lever sensor, a work machine speed sensor, an articulation angle sensor, an articulation lever sensor, a hydraulic oil temperature sensor, an implement position and/or orientation sensor, a timer, and/or the like. For example, a steering angle sensor may provide information indicating an actual steering angle for the work machine 100 (e.g., a command being provided to the secondary control device 308) and the steering lever sensor may provide information indicating an intended steering angle of the work machine 100. Similarly, an articulation angle sensor may provide information indicating an actual articulation angle of the implement 110 and the articulation lever sensor may provide information indicating an intended articulation angle (e.g., a command being provided to the secondary control device 308) of the implement 110.

The set of sensor devices of the secondary control inputs 304 may include some or all of the sensor devices included in the set of sensor device of the main control inputs 302. Additionally, or alternatively, the set of sensor devices of the secondary control inputs 304 may be different than the sensor devices included in the set of sensor device of the main control inputs 302 (e.g., sensor devices of the main control device 306 may be "primary" sensor devices and sensor devices of the secondary control device 308 may be "backup" or "redundant" sensor devices). Moreover, the main monitoring information may include main data (e.g., regarding work machine 100, implement 110, and/or the like) and the secondary monitoring information may include secondary data (e.g., regarding work machine 100, implement 110, and/or the like). The main data may be different than the secondary data (e.g., the main data may indicate a main measurement of a property of implement 110 that is different than a secondary measurement of the property indicated by the secondary data).

The main control device 306 may be a control device, an electronic control unit (ECU), and/or the like of the work machine 100. The main control device 306 may generate main control information to control the work machine 100 and/or a component of the work machine 100, such as the implement 110. For example, the main control device 306 may obtain main monitoring information from the main control inputs 302 and generate the main control information based on the main monitoring information (e.g., by executing a program using the main monitoring information as input to the program). The main control device 306 may use a main processing technique to generate the main control information (e.g., the main control device 306 may perform complex calculations as part of an algorithm to determine the main control information). The main control device 306 may send the main control information to the secondary control device 308 and/or the main outputs 310 to control the work machine 100 and/or the component.

The secondary control device 308 may be a control device, an ECU, and/or the like of the work machine 100. The secondary control device 308 may determine whether a critical error has occurred with respect to the work machine 100 and/or a component of the work machine 100, such as the implement 110. Accordingly, the secondary control device 308 may control the work machine 100 and/or the component to move to a default position and/or shut down (e.g., to stop movement of the work machine 100 and/or the component). For example, the secondary control device 308 may control the work the component to move to a neutral position and then may control the work machine 100 to shut down.

In some implementations, the secondary control device 308 may obtain the main control information and/or the main monitoring information from the main control device 306 and/or may obtain the secondary monitoring information from the secondary control inputs 304. The secondary control device 308 may generate secondary control information based on the secondary monitoring information (e.g., by executing a program using the secondary monitoring information as input to the program).

The main control device 306 may use a first main processing technique to determine the secondary control information. The first main processing technique may have a same or similar complexity, a same or similar resource requirement (e.g., a processing resource requirement, a memory resource requirement, a power resource requirement, and/or the like), and/or the like as the main processing technique used by the main control device 306 to process the main monitoring information to determine the main control information. Additionally, or alternatively, the secondary control device 308 may use a first reduced functionality processing technique to determine the secondary control information. That is, the first reduced functionality processing technique may have a reduced functionality (e.g., a reduced complexity, a reduced resource requirement, a reduced accuracy, a reduced precision, a reduced fidelity, a reduced response rate, a delayed response time, and/or the like) with respect to the first main processing technique. For example, the first reduced functionality processing technique may include determining the secondary control information by searching a lookup table based on the secondary monitoring information (as opposed to the first main processing technique that includes performing complex calculations as part of an algorithm to determine the secondary control information).

In some implementations, the secondary control device 308 may determine whether a critical error has occurred with respect to the work machine 100 and/or a component of the work machine 100, such as the implement 110. The secondary control device 308 may determine that a critical error has occurred based on the main monitoring information. For example, the secondary control device 308 may determine that a sensor device associated with the main control inputs 302 has failed (e.g., data of the main monitoring information associated with the sensor device is missing and/or erroneous).

Similarly, the secondary control device 308 may determine that a critical error has occurred based on the secondary monitoring information. For example, the secondary control device 308 may determine that a sensor device associated with the second control inputs 304 has failed (e.g., data of the second monitoring information associated with the sensor device is corrupted). Moreover, the secondary control device 308 may determine that a critical error has occurred based on the main monitoring information and the secondary monitoring information. For example, the secondary control device 308 may determine, based on the main monitoring information, a main measurement associated with a property (e.g., a height) of a component of work machine 100, such as implement 110, and may determine, based on the secondary monitoring information, a secondary measurement associated with the property of the component. The secondary control device 308 may determine that the main measurement and the secondary measurement are inconsistent (e.g., do not match within a tolerance, such as a 3% tolerance) and that therefore a critical error has occurred.

The secondary control device 308 may determine that a critical error has occurred based on the main monitoring information and the main control information. For example, the secondary control device 308 may determine, based on the main monitoring information, a measurement associated with a property of a component (e.g., a direction of motion of the component) of work machine 100, such as implement 110, and may determine, based on the main control information, a control command associated with the property of the component (e.g., a command to move the component in a particular direction). The secondary control device 308 may determine that the measurement is inconsistent with the control command (e.g., the direction of motion of the component is not the same as the particular direction) to determine that the critical error has occurred.

The secondary control device 308 may determine that a critical error has occurred based on the secondary monitoring information and the secondary control information. For example, the secondary control device 308 may determine, based on the secondary monitoring information, a measurement associated with a property of a component (e.g., a tilt angle of the component) of work machine 100, such as implement 110, and may determine, based on the secondary control information, a control command associated with the property of the component (e.g., a command to tilt the component to a particular tilt angle). The secondary control device 308 may determine that the measurement is inconsistent with the control command (e.g., the tilt angle of the component is not the same as the particular tilt angle) to determine that the critical error has occurred.

The secondary control device 308 may determine that a critical error has occurred when the secondary control information is inconsistent with the main control information. For example, the secondary control device 308 may determine, based on the main control information, at least one first control command and may determine, based on the secondary control information, at least one second control command. A first number of commands associated with the at least one first control command may be greater than a second number of commands associated with the at least one second control command. The secondary control device 308 may determine and/or identify a particular first control command, of the at least one first control command, and a particular second control command, of the at least one second control command, such that the particular first control command corresponds to the particular second control command (e.g., the particular first control command and the particular second control command control the same component, such as implement 110). The secondary control device 308 may determine that the particular first control command and the particular second control command are inconsistent, do not match, and/or the like and that therefore a critical error has occurred. As an example, the secondary control device 308 may determine that a critical error has occurred when a particular first control command specifies articulating implement 110 in a particular direction and a particular second control command specifies articulating implement 110 in an opposite direction.

The secondary control device 308 may use a second functionality processing technique to determine whether the critical error has occurred. For example, the secondary control device 308 may use a second main processing technique to determine whether the critical error has occurred (e.g., a full functionality processing technique that has a same or similar complexity, resource requirement, and/or the like as the first main processing technique). As another example, the secondary control device 308 may use a second reduced functionality processing technique to determine whether the critical error has occurred. That is, the secondary control device 308 may process the secondary monitoring information using a processing technique that has reduced functionality (e.g., a reduced complexity, a reduced resource requirement, a reduced accuracy, a reduced precision, a reduced fidelity, a reduced response rate, a delayed response time, and/or the like) with respect to the second main processing technique. For example, the second reduced functionality processing technique may determine only a particular direction of movement of a component of work machine 100, as opposed to the second main processing technique also determining a rate of speed of movement of the component, to determine whether a critical error has occurred.

Furthermore, the secondary control device 308 may enable the second reduced functionality processing technique to include one or more additional capabilities (hereinafter referred to as an "enhanced second reduced functionality processing technique"). The one or more additional capabilities distinguish the enhanced second reduced functionality processing technique from the second reduced functionality processing technique that does not utilize the one or more additional capabilities (hereinafter referred to as an "unenhanced second reduced functionality processing technique").

For example, the enhanced second reduced functionality processing technique may have a faster processing rate capability and/or may have a faster data link rate capability with other devices (e.g., the main control device 306, the secondary control inputs 304, other ECUs associated with work machine 100, and/or the like) than utilized by the unenhanced second reduced functionality processing technique. As another example, the enhanced second reduced functionality processing technique may have a better or more advanced (e.g., faster, more efficient, and/or the like) diagnostic capability, a better or more advanced (e.g., faster, more efficient, and/or the like) sensor data update rate (e.g., from secondary control inputs 304) capability, a better or more advanced (e.g., higher, more efficient, and/or the like) data resolution processing capability, and/or the like than utilized by the unenhanced second reduced functionality processing technique. In another example, the enhanced second reduced functionality processing technique may include a low power capability that conserves processing power of the secondary control device 308. The enhanced second reduced functionality processing technique may enable the secondary control device 308 to reduce an amount of power used to perform one of the functions described herein for a period of time (e.g., scale back a processing capability of the secondary control device 308 for the period of time) to allow the secondary control device 308 to also perform another function during the period of time.

The secondary control device 308 may determine to use the second main processing technique, the unenhanced second reduced functionality processing technique, or the enhanced second reduced functionality processing technique based on one or more factors. For example, the secondary control device 308 may always use the second main processing technique for a first particular component and may always use the unenhanced second reduced functionality processing technique for a second particular component. As another example, the secondary control device 308 may use the second main processing technique in some situations (e.g., when an oil temperature associated with work machine 100 is at a low temperature, such as below 100 degrees Celsius), may use the enhanced second reduced functionality processing technique in other situations (e.g., when the oil temperature is at a moderate temperature, such as greater than or equal to 100 degrees Celsius and below 150 degrees Celsius), and may use the unenhanced second reduced functionality processing technique in additional situations (e.g., when the oil temperature is at a high temperature, such as greater than or equal to 150 degrees Celsius). In an additional example, the secondary control device 308 may use the unenhanced second reduced functionality processing technique when a parameter associated with a component satisfies a threshold (e.g., a height of the component is greater than or equal to a particular height) and may use the enhanced second reduced functionality processing technique when the parameter does not satisfy the threshold (e.g., the height of the component is less than the particular height).

When the secondary control device 308 determines that a critical error has not occurred, the secondary control device 308 may allow the main control device 306 to send the main control information to the main outputs 310. When the secondary control device 308 determines that a critical error has occurred, the secondary control device 308 may send a message to the main control device 306 and/or another device (e.g., a display associated with operator controls 112) indicating that the secondary control device 308 detected a critical error. The secondary control device 308 may prevent the main control device 306 from sending the main control information to the main outputs 310.

In some implementations, the secondary control device 308 may determine a circumstance associated with the critical error. The secondary control device 308 may determine the circumstance based on the main monitoring information and/or the secondary monitoring information. For example, the secondary control device 308 may determine, based on the main monitoring information and/or the second monitoring information, a measurement associated with a property of the implement (e.g., a height of the implement). The secondary control device 308 may determine that the measurement satisfies a particular threshold (e.g., the height of the implement is less than the particular threshold) and may determine a particular circumstance based on the measurement satisfying the particular threshold. For example, the secondary control device 308 may determine that the particular circumstance is an urgent circumstance (e.g., a work machine endangering circumstance; an implement endangering circumstance; a physical property endangering circumstance; and/or the like) or a non-urgent circumstance (e.g., a work machine malfunctioning circumstance; an implement malfunctioning circumstance; and/or the like) based on the measurement satisfying the particular threshold. In a specific example, the secondary control device 308 may determine that a particular circumstance of a dozer driving on a roadway is an urgent circumstance when a height of a blade of the dozer drops below a height threshold of one meter.

In some implementations, the secondary control device 308 may select a control technique based on determining the circumstance. The control technique may be a increased functionality control technique or a reduced functionality control technique. For example, the secondary control device 308 may select the reduced functionality control technique when the secondary control device 308 determines that the circumstance is a non-urgent circumstance. As another example, the secondary control device 308 may select the increased functionality control technique when the secondary control device 308 determines that the circumstance is an urgent circumstance.

The reduced functionality control technique may have a reduced functionality (e.g., a reduced complexity, a reduced resource requirement, a reduced accuracy, a reduced precision, a reduced fidelity, a reduced response rate, a delayed response time, and/or the like) with respect to the increased functionality control technique. For example, the reduced functionality control technique may include determining a constant speed and a stopping position for controlling a component of the work machine 100, as opposed to the increased functionality control technique that may include determining a variable speed, a starting time, a stopping time, one or more stopping positions, and/or the like for controlling the component.

In some implementations, the secondary control device 308 may control a component of work machine 100, such as implement 110, using the control technique selected by the secondary control device 308. The secondary control device 308 may control the component by sending one or more commands to the secondary outputs 312. The secondary control device 308 may control the component to move to a default position (e.g., as shown in FIG. 2, moving articulating implement 110 to a neutral position, shown as a 0 degree position) using the selected control technique. For example, the secondary control device 308 may control the component to move to the default position at a variable speed when the selection is the increased functionality control technique. As another example, the secondary control device 308 may control the component to move to the default position at a constant speed when the selection is the reduced functionality control technique. The secondary control device 308 may cause the work machine 100 and/or the component to stop and/or shut down (e.g., after controlling the component to move to the default position). In some implementations, the secondary control device 308 may send a message to the main control device 306 and/or another device (e.g., a display associated with operator controls 112) indicating that the secondary control device 308 is controlling and/or has controlled the work machine 100 and/or the component.

The main outputs 310 may include at least one control device (e.g., a controller, an ECU, an actuator, and/or the like) that controls the work machine 100 and/or one or more components of the work machine 100, such as implement 110. For example, the main outputs 310, based on receiving one or more commands from the main control device 306, may control a solenoid and/or a pilot supply associated with the implement 110 to cause the implement to move (e.g., articulate) toward a particular direction, such as a neutral position.

The secondary outputs 312 may include at least one control device (e.g., a controller, an ECU, an actuator, and/or the like) that controls the work machine 100 and/or one or more components of the work machine 100, such as implement 110. For example, the secondary outputs 312, based on receiving one or more commands from the secondary control device 308, may control a solenoid and/or a pilot supply associated with the implement 110 to cause the implement to move (e.g., articulate) toward a particular direction, such as a neutral position.

The at least one control device of the secondary outputs 312 may include some or all of the control devices of the at least one control device of the main outputs 310. Additionally, or alternatively, the at least one control device of the secondary outputs 312 may be different than the at least one control device of the main outputs 310.

The number and arrangement of devices shown in FIG. 3 are provided as an example. In practice, there may be additional devices, fewer devices, different devices, or differently arranged devices than those shown in FIG. 3. Furthermore, two or more devices shown in FIG. 3 may be implemented within a single device, or a single device shown in FIG. 3 may be implemented as multiple, distributed devices. Additionally, or alternatively, a set of devices (e.g., one or more devices) of environment 300 may perform one or more functions described as being performed by another set of devices of environment 300.

Figure 4:
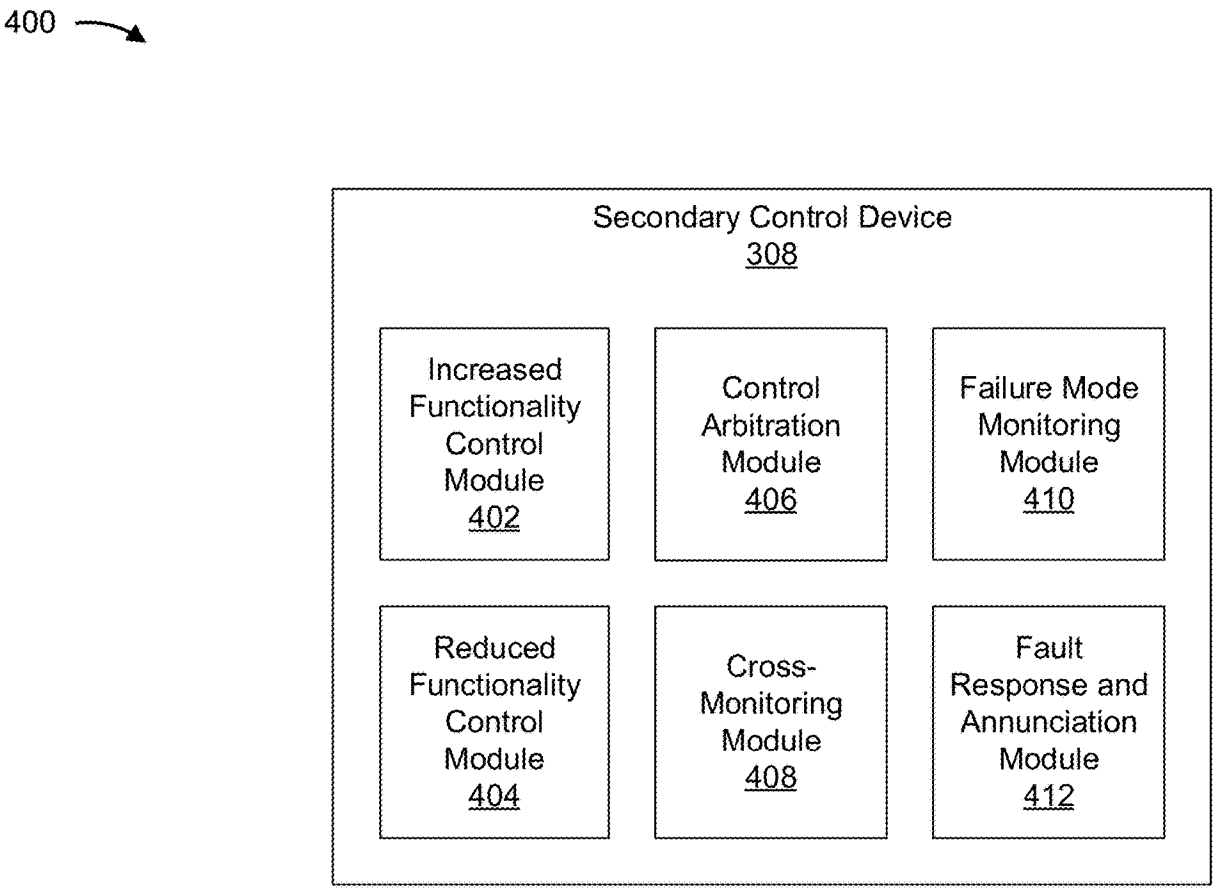
FIG. 4 is a diagram of an example secondary control device described herein.

FIG. 4 is a diagram of an example secondary control device 308 described herein. As shown in FIG. 4 and by reference number 400, the secondary control device 308 may include an increased functionality control module 402, a reduced functionality control module 404, a control arbitration module 406, a cross-monitoring module 408, a failure mode monitoring module 410, a fault response and annunciation module 412, and/or the like (collectively referred to herein as "the modules"). As described herein, the secondary control device 308 and/or the modules may be implemented in hardware via at least one processor (e.g., processor 520) and/or at least one memory (e.g., memory 530).

The secondary control device 308 may use the increased functionality control module 402, alone or in combination with other modules, to perform one or more functions as described herein. When using the increased functionality control module 402, the secondary control device 308 may perform the one or more functions in a same or similar manner as the main control device 306 would perform the one or more functions (e.g., the secondary control device 308 may use a same or similar processing technique as the main control device 306). For example, the secondary control device 308 may use an algorithm that has a same or similar complexity, a same or similar resource requirement (e.g., a processing resource requirement, a memory resource requirement, a power resource requirement, and/or the like), a same or similar functionality, and/or the like as an algorithm used by the main control device 306.

The secondary control device 308 may use the reduced functionality control module 404, alone or in combination with other modules, to perform one or more functions as described herein. When using the reduced functionality control module 404, the secondary control device 308 may perform the one or more functions in a manner that is different than the secondary control device 308 would perform the one or more functions using the increased functionality control module 402. For example, using the reduced functionality control module 404, the secondary control device 308 may use one or more reduced functionality techniques (e.g., control or processing techniques) that may have a reduced functionality with respect to techniques utilized by the secondary control device 308 when using the increased functionality control module 402. For example, using the reduced functionality control module 404, the secondary control device 308 may use an algorithm that has a reduced complexity, a reduced resource requirement (e.g., processing resource requirement, memory resource requirement, power resource requirement, and/or the like) and/or the like as compared to an algorithm utilized by the secondary control device 308 when using the increased functionality control module 402.

In some implementations, the secondary control device 308 may use the control arbitration module 406, the cross-monitoring module 408, and/or the failure mode monitoring module 410 to determine that a critical error has occurred (e.g., associated with a component of work machine 100, such as implement 110), as described herein. When using the control arbitration module 406, the secondary control device 308 may determine the critical error based on the main monitoring information and/or the main control information, as described herein. When using the cross-monitoring module 408, the secondary control device 308 may determine the critical error based on the main control information and/or the secondary control information, as described herein. When using the failure mode monitoring module 410, the secondary control device 308 may determine the critical error based on the secondary monitoring information and/or the secondary control information, as described herein.

The secondary control device 308 may use the fault response and annunciation module 412 to control a component of the work machine 100, such as the implement 110, after determining that the critical error has occurred. When using the fault response and annunciation module 412, the secondary control device 308 may control the component to move to a default position, shut down, and/or the like, as described herein.

The number and arrangement of modules shown in FIG. 4 are provided as an example. In practice, there may be additional modules, fewer modules, different modules, or differently arranged modules than those shown in FIG. 4. Furthermore, two or more modules shown in FIG. 4 may be implemented as a single module, or a single module shown in FIG. 4 may be implemented as multiple, distributed modules. A set of modules (e.g., one or more modules) of the secondary control device 308 may perform one or more functions described as being performed by another set of modules of the secondary control device 308.

Figure 5:
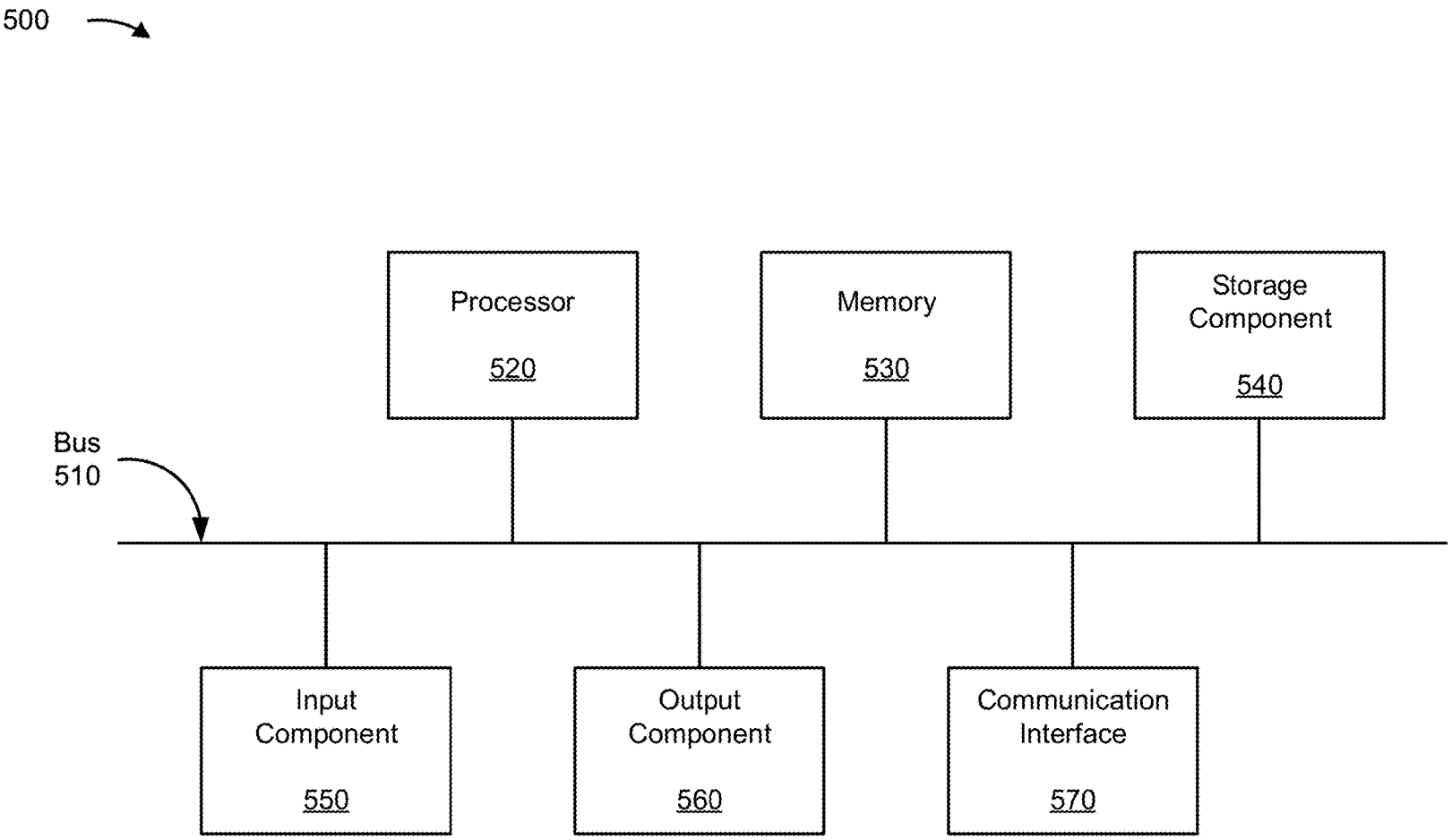
FIG. 5 is a diagram of example components of one or more systems and/or devices described herein.

FIG. 5 is a diagram of example components of a device 500. Device 500 may correspond to main control input 302, secondary control input 304, main control device 306, secondary control device 308, main output 310, and/or secondary output 312. In some implementations, main control input 302, secondary control input 304, main control device 306, secondary control device 308, main output 310, and/or secondary output 312 may include one or more devices 500 and/or one or more components of device 500. As shown in FIG. 5, device 500 may include a bus 510, a processor 520, a memory 530, a storage component 540, an input component 550, an output component 560, and a communication interface 570.

Bus 510 includes a component that permits communication among the components of device 500. Processor 520 is implemented in hardware, firmware, and/or a combination of hardware and software. Processor 520 is a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. Processor 520 includes one or more processors capable of being programmed to perform a function. Memory 530 includes a random access memory (RAM), a read only memory (ROM), and/or another type of dynamic or static storage device (e.g., a flash memory, a magnetic memory, and/or an optical memory) that stores information and/or instructions for use by processor 520.

Storage component 540 stores information and/or software related to the operation and use of device 500. For example, storage component 540 may include a hard disk (e.g., a magnetic disk, an optical disk, a magneto-optic disk, and/or a solid state disk), a compact disc (CD), a digital versatile disc (DVD), a floppy disk, a cartridge, a magnetic tape, and/or another type of non-transitory computer-readable medium, along with a corresponding drive.

Input component 550 includes a component that permits device 500 to receive information, such as via user input (e.g., a touch screen display, a keyboard, a keypad, a mouse, a button, a switch, and/or a microphone). Input component 550 may include a sensor for sensing information (e.g., a global positioning system (GPS) component, an accelerometer, a gyroscope, and/or an actuator). Output component 560 includes a component that provides output information from device 500 (e.g., a display, a speaker, and/or one or more light-emitting diodes (LEDs)).

Communication interface 570 includes a transceiver-like component (e.g., a transceiver and/or a separate receiver and transmitter) that enables device 500 to communicate with other devices, such as via a wired connection, a wireless connection, or a combination of wired and wireless connections. Communication interface 570 may permit device 500 to receive information from another device and/or provide information to another device. For example, communication interface 570 may include an Ethernet interface, an optical interface, a coaxial interface, an infrared interface, a radio frequency (RF) interface, a universal serial bus (USB) interface, a Wi-Fi interface, a cellular network interface, or the like.

Device 500 may perform one or more processes described herein. Device 500 may perform these processes based on to processor 520 executing software instructions stored by a non-transitory computer-readable medium, such as memory 530 and/or storage component 540. A computer-readable medium is defined herein as a non-transitory memory device. A memory device includes memory space within a single physical storage device or memory space spread across multiple physical storage devices.

Software instructions may be read into memory 530 and/or storage component 540 from another computer-readable medium or from another device via communication interface 570. When executed, software instructions stored in memory 530 and/or storage component 540 may cause processor 520 to perform one or more processes described herein. Hardwired circuitry may be used in place of or in combination with software instructions to perform one or more processes described herein. Thus, implementations described herein are not limited to any specific combination of hardware circuitry and software.

The number and arrangement of components shown in FIG. 5 are provided as an example. In practice, device 500 may include additional components, fewer components, different components, or differently arranged components than those shown in FIG. 5. A set of components (e.g., one or more components) of device 500 may perform one or more functions described as being performed by another set of components of device 500.

Figure 6:
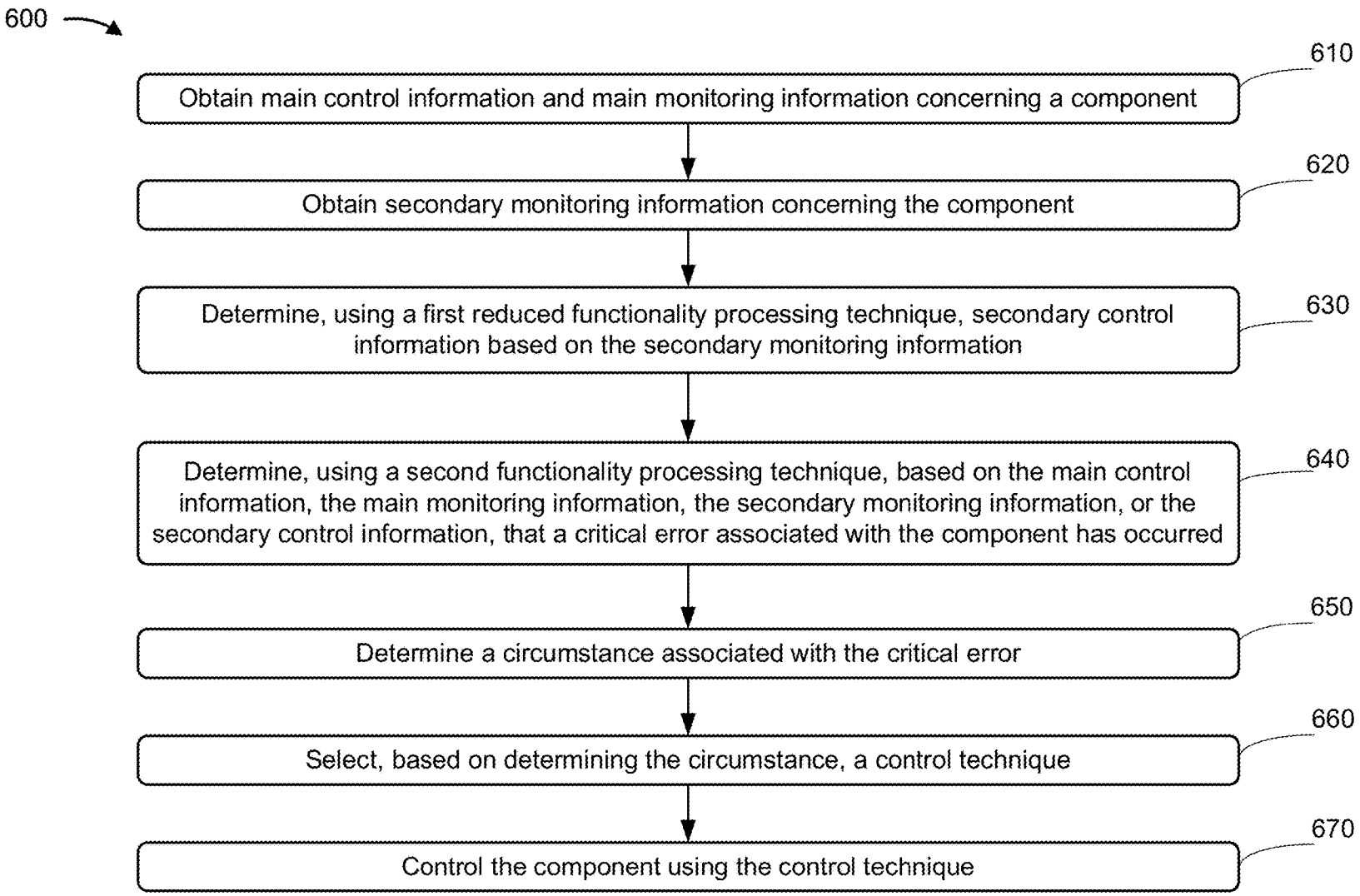
FIG. 6 is a flow chart of an example process associated with a secondary control device for a work machine described herein.

FIG. 6 is a flow chart of an example process 600 associated with a secondary control device for a work machine described herein. One or more process blocks of FIG. 6 may be performed by a secondary control device (e.g. secondary control device 308). Additionally, or alternatively, one or more process blocks of FIG. 6 may be performed by another device or a group of devices separate from or including the secondary control device, such as a main control input (e.g., main control input 302), a secondary control input (e.g., secondary control input 304), a main control device (e.g., main control device 306), a main output (e.g., main output 310), a secondary output (e.g., secondary output 312), and/or the like.

As shown in FIG. 6, process 600 may include obtaining main control information and main monitoring information concerning a component (block 610). For example, the secondary control device (e.g., using processor 320, memory 330, storage component 340, input component 350, output component 360, communication interface 370 and/or the like) may obtain main control information and main monitoring information concerning a component, as described above.

As further shown in FIG. 6, process 600 may include obtaining secondary monitoring information concerning the component (block 620). For example, the secondary control device (e.g., using processor 320, memory 330, storage component 340, input component 350, output component 360, communication interface 370 and/or the like) may obtain secondary monitoring information concerning the component, as described above.

As further shown in FIG. 6, process 600 may include determining, using a first reduced functionality processing technique, secondary control information based on the secondary monitoring information (block 630). For example, the secondary control device (e.g., using processor 320, memory 330, storage component 340, input component 350, output component 360, communication interface 370 and/or the like) may determine, using a first reduced functionality processing technique, secondary control information based on the secondary monitoring information, as described above.

As further shown in FIG. 6, process 600 may include determining, using a second functionality processing technique, based on the main control information, the main monitoring information, the secondary monitoring information, or the secondary control information, that a critical error associated with the component has occurred (block 640). For example, the secondary control device (e.g., using processor 320, memory 330, storage component 340, input component 350, output component 360, communication interface 370 and/or the like) may determine, using a second functionality processing technique, based on the main control information, the main monitoring information, the secondary monitoring information, or the secondary control information, that a critical error associated with the component has occurred, as described above.

As further shown in FIG. 6, process 600 may include determining a circumstance associated with the critical error (block 650). For example, the secondary control device (e.g., using processor 320, memory 330, storage component 340, input component 350, output component 360, communication interface 370 and/or the like) may determine a circumstance associated with the critical error, as described above.

As further shown in FIG. 6, process 600 may include selecting, based on determining the circumstance, a control technique (block 660). For example, the secondary control device (e.g., using processor 320, memory 330, storage component 340, input component 350, output component 360, communication interface 370 and/or the like) may select, based on determining the circumstance, a control technique, as described above.

As further shown in FIG. 6, process 600 may include controlling the component using the control technique (block 670). For example, the secondary control device (e.g., using processor 320, memory 330, storage component 340, input component 350, output component 360, communication interface 370 and/or the like) may control the component using the control technique, as described above.

Process 600 may include additional implementations, such as any single implementation or any combination of implementations described in connection with one or more other processes described elsewhere herein.

Although FIG. 6 shows example blocks of process 600, in some implementations, process 600 may include additional blocks, fewer blocks, different blocks, or differently arranged blocks than those depicted in FIG. 6. Additionally, or alternatively, two or more of the blocks of process 600 may be performed in parallel.

INDUSTRIAL APPLICABILITY

The disclosed secondary control device (e.g., the secondary control device 308) may be used with any work machine where a technique for detecting a critical error and/or controlling a component of the work machine is needed. The disclosed secondary control device may analyze main monitoring information, secondary monitoring information, and/or main control information, obtained by the secondary control device and and/or secondary control information to determine whether a critical error has occurred. In the case where the secondary control device determines that a critical error has occurred, the secondary control device 308 may determine a circumstance associated with the critical error and may select, based on the determining the circumstance, a control technique, such as a reduced functionality control technique, for controlling the component of the work machine. The secondary control device 308 may control the component using the selected control technique.

Notably, the secondary control device may use one or more reduced functionality processing techniques to determine whether the critical error has occurred. Moreover, the secondary control device may use a reduced functionality control technique to control the component of the work machine. Using reduced functionality processing and control techniques enables the secondary control device to use less resources (e.g., processing resources, memory resources, power resources, and/or the like) than would be used by an alternative control device using full functionality processing and control techniques. For example, the secondary control device may use computer code that is less complex and requires less resources to execute. Accordingly, the secondary control device may use hardware (e.g., processors, memory, input and output components, and/or the like) that is smaller, less powerful, and/or the like, which may make the secondary control device more reliable and/or easier to protect within the work machine. This may decrease a likelihood of failure of the secondary control device, which therefore minimizes a likelihood of damage to the work machine, the component, an operator of the work machine, a pedestrian, another work machine or vehicle, and/or the like.

Moreover, the computer code used by the secondary control device may utilize different algorithms and/or coding schemes than computer code used by a main device of the working machine. This may decrease a likelihood of a logic failure being similarly implemented on the main device and the secondary control device. Accordingly, the secondary control device 308 may be more likely to identify a critical error than an alternative device that uses the same or similar code to monitor the main device.

What is claimed is:

1. A method, comprising:

obtaining, by a device, main control information regarding an implement;

obtaining, by the device, monitoring information regarding the implement;

determining, by the device and using a first reduced functionality processing technique, secondary control information regarding the implement based on the monitoring information;

determining, by the device and based on the main control information, a first control command to control a movement of the implement;

determining, by the device and based on the secondary control information, a second control command corresponding to the first control command;

determining, by the device, the first control command does not match the second control command;

determining, by the device, that a critical error associated with the implement has occurred based on determining that the first control command does not match the second control command;

determining, by the device, a circumstance associated with the critical error;

selecting, by the device and based on determining the circumstance, a control technique; and controlling, by the device and using the control technique, the implement to move to a particular position.

2. The method of claim 1, wherein the control technique is:

an increased functionality control technique; or a reduced functionality control technique, wherein the reduced functionality control technique has reduced functionality with respect to the main control technique.

3. The method of claim 1, wherein determining the secondary control information regarding the implement comprises:

determining the secondary control information by searching a lookup table based on the monitoring information.

4. The method of claim 1, wherein determining that the first control command does not match the second control command comprises:

determining that the first control command causes the implement to move in a first direction;

determining that the second control command causes the implement to move in a second direction opposite the first direction; and determining that the first control command does not match the second control command based on determining that the second control command causes the implement to move in the second direction opposite the first direction.

5. The method of claim 1, wherein determining that the critical error associated with the implement has occurred comprises:

determining that a sensor device associated with generating the monitoring information has failed.

6. The method of claim 1, wherein determining the circumstance associated with the critical error comprises:

determining, based on the monitoring information, a measurement associated with a property of the implement;

determining that the measurement satisfies a particular threshold; and determining a particular circumstance based on the measurement satisfying the particular threshold.

7. The method of claim 1, wherein selecting the control technique comprises:

selecting a reduced functionality control technique when the circumstance is determined to be a non-urgent circumstance; or selecting an increased functionality control technique when the circumstance is determined to be an urgent circumstance.

8. A device, comprising:

one or more memories; and one or more processors communicatively coupled to the one or more memories, to:

obtain main control information regarding an implement from a different device;

obtain monitoring information regarding the implement;

determine, using a first reduced functionality processing technique, secondary control information regarding the implement based on the monitoring information;

determine, based on the main control information and the secondary control information, that a first movement of the implement, caused by a first control command, does not match a second movement of the implement caused by a second control command corresponding to the first control command;

determine that the first control command and the second control command are inconsistent based on determining that the first movement does not match the second movement;

determine, using a reduced functionality processing technique, that a critical error associated with the implement has occurred based on determining that the first control command and the second control command are inconsistent;

determine a circumstance associated with the critical error;

select, based on determining the circumstance, a reduced functionality control technique or an increased functionality control technique; and control the implement to move to a particular position based on the selection.

9. The device of claim 8, wherein the main control information is determined by the different device based on alternative monitoring information regarding the implement, and wherein the monitoring information includes data regarding the implement that is different than data regarding the implement that is included in the alternative monitoring information.

10. The device of claim 8, wherein the one or more processors, when determining that the first control command and the second control command are inconsistent, are to:

determine that the first control command causes the implement to move in a first direction; and that the second control command causes the implement to move in a second direction different than the first direction; and determine that the first control command and the second control command are inconsistent based on determining that the second control command causes the implement to move in the second direction different than the first direction.

11. The device of claim 8, wherein the one or more processors, when determining that the first control command and the second control command are inconsistent, are to:

identify, based on the main control information, a plurality of first control commands; and identify, based on the secondary control information, at least one second control command, wherein a first number of commands associated with the plurality of first control commands is greater than a second number of commands associated with the at least one second control command, wherein the plurality of first control commands include the first control command, and wherein the at least one second control command includes the second control command.

12. The device of claim 8, wherein the one or more processors, when controlling the implement, are to:

control the implement to move to a default position at a variable speed when the selection is the increased functionality control technique, wherein the default position is the particular position.

13. The device of claim 8, wherein the one or more processors, when controlling the implement to move, are to:

control the implement to move to a default position at a constant speed when the selection is the reduced functionality control technique, wherein the default position is the particular position.

14. A work machine comprising:

an implement;

a main control device capable of generating main control information to control the implement based on main monitoring information regarding the implement;

a secondary control device to:

obtain the main control information and the main monitoring information from the main control device;

obtain secondary monitoring information regarding the implement;

determine, using a first reduced functionality processing technique, secondary control information regarding the implement based on the secondary monitoring information;

select a second functionality processing technique based on the main control information, the main monitoring information, the secondary monitoring information, or the secondary control information;

determine, based on the main control information and the secondary control information, that a first movement of the implement, caused by a first control command, does not match a second movement of the implement caused by a second control command corresponding to the first control command;

determine that the first control command and the second control command are inconsistent based on determining that the first movement does not match the second movement;

determine, using the second functionality processing technique, that a critical error associated with the implement has occurred based on determining that the first control command and the second control command are inconsistent;

determine a circumstance associated with the critical error;

select, based on determining the circumstance, a control technique; and control the implement to move to a particular position, using the control technique.

15. The work machine of claim 14, wherein the second functionality processing technique is:

an unenhanced second reduced functionality processing technique; or an enhanced second reduced functionality processing technique, wherein the enhanced second reduced functionality processing technique has one or more additional capabilities with respect to the unenhanced second reduced functionality processing technique.

16. The work machine of claim 15, wherein the secondary control device, when selecting the second functionality processing technique, is to:

determine whether a parameter associated with the implement satisfies a threshold; and select, after determining that the parameter satisfies the threshold, the unenhanced second reduced functionality processing technique; or select, after determining that the parameter does not satisfy the threshold, the enhanced second reduced functionality processing technique.

17. The work machine of claim 15, wherein the one or more additional capabilities of the enhanced second reduced functionality technique includes at least one of:

a faster processing rate capability, a faster data link rate capability, a faster diagnostic capability, a faster sensor data update rate, a higher data resolution processing capability, or a low power capability.

18. The work machine of claim 15, wherein the second functionality processing technique is the enhanced second reduced functionality processing technique, and wherein the secondary control device, when determining that the critical error associated with the implement has occurred, is to:

determine that the critical error associated with the implement has occurred based on utilizing the one or more additional capabilities of the enhanced second reduced functionality processing technique.

19. The work machine of claim 14, wherein the secondary control device, when determining that the critical error associated with the implement has occurred, is to:

determine, based on the main monitoring information, a measurement associated with a property of the implement;

determine, based on the main control information, a control command associated with the property of the implement, wherein the control command is the first control command; and determine that the measurement is inconsistent with the control command.

20. The work machine of claim 14, wherein the secondary control device, when determining that the critical error associated with the implement has occurred, is to:

determine, based on the secondary monitoring information, a measurement associated with a property of the implement;

determine, based on the secondary control information, a control command associated with the property of the implement, wherein the control command is the second control command; and determine that the measurement is inconsistent with the control command.

* * * * *